US005762148A

United States Patent [19]

Kattentidt et al.

[11] Patent Number: 5,762,148

[45] Date of Patent: Jun. 9, 1998

[54] BORING TOOL

[75] Inventors: Hinrich Kattentidt, Darmstadt; Achim Kehrberger, Ostfildern; Winfried Scheid, Ebersbach, all of Germany

[73] Assignee: DELMAG Maschinenfabrik Reinhold Dornfeld GmbH & Co., Esslingen, Germany

[21] Appl. No.: 625,351

[22] Filed: Apr. 1, 1996

[30] Foreign Application Priority Data

Apr. 1, 1995 [DE] Germany ..... 195 12 070.1

[51] Int. Cl.[6] ..... E21B 7/02

[52] U.S. Cl. ..... 173/184; 173/28; 173/147; 173/148

[58] Field of Search ..... 173/141, 144, 173/145, 148, 149, 147, 152, 160, 164, 185, 28

[56] References Cited

U.S. PATENT DOCUMENTS 3,851,714 12/1974 Visser et al. ..... 173/164

4,473,325 9/1984 Beney et al. ..... 173/185

4,832,536 5/1989 Spross et al. ..... 173/184

*Primary Examiner*—Scott A. Smith

*Attorney, Agent, or Firm*—Dinsmore & Shohl LLP

[57] ABSTRACT

A boring tool with two driving heads which are used to sink a casing string and a borer string includes a controllable coupling mechanism fitted between the two driving heads. A mechanism is also provided for the lower driving head, such that the driving head is subjected to an additional downwards acting force. When both driving heads are coupled, the upper driving head is also subjected to an additional, downwards acting vertical force. In order to free the top end of the casing string, the coupling mechanism can be released so that the upper driving head can be fully raised, whilst the lower driving head remains in position adjacent to the ground.

27 Claims, 7 Drawing Sheets

BORING TOOL

BACKGROUND TO THE INVENTION

The invention concerns a boring tool

A boring tool is described in DE-A-3326303. It comprises a sledger, with a first driving head mounted on the sledger such that it can move, which has a driven part which can be connected to the end of a casing string, a second driving head mounted on the sledger such that it is capable of movement and above the first driving head which has a driven part which can be connected to the end of a borer string and lifting devices which are used to raise the two driving heads on the sledger.

In the disclosed tool, two separate lifting jacks are provided, one of which works on the first driving head operating at the casing end and the second of which works on the second driving head operating at the borer string end. The two driving heads and the parts connected with them are lowered by the effect of gravity.

SUMMARY OF THE INVENTION

The present invention provides a boring tool in which the force used to push both driving heads vertically downwards can be intensified.

Accordingly, in one aspect, the invention provides a boring tool, comprising a sledger, with a first driving head mounted on the sledger such that it can move, which has a driven part which can be connected to the end of a casing string, a second driving head mounted on the sledger such that it is capable of movement and above the first driving head which has a driven part which can be connected to the end of a borer string and lifting devices which are used to raise the two driving heads on the sledger, in which a coupling device is provided, by means of which the two driving heads can be locked, but can also be detached, to allow them to move together along the sledger and in that a pressure device operates on the first driving head which supplies a downwards force parallel to the sledger axis.

in the boring tool according to the invention a pressure device is provided which can exert a force on the two driving heads which acts in the advance direction of the casing string or the borer string. If the two driving heads are coupled together then they will both move vertically downwards due to the effect of the pressure device. In the coupled state, both lifting devices can also raise both driving heads together and thus, if necessary, together pull a casing string. Once the coupling between the two driving heads is released, the upper, second driving head can be moved vertically upwards by itself so that the borer string is freed from the casing string. Consequently, the upper end of the casing string is then also accessible and a reinforcing cage or a double T beam can be lowered via the casing string into the bore hole produced and only after these items have been inserted will the inside of the casing be completely filled with concrete (inserted item is a reinforcing cage; pile foundation) or only the lower section will be filled with concrete (inserted item is a beam; Berlin sheeting). The concrete also no longer needs to be poured in through the inside of the borer but can also be introduced directly at the top end of the casing string.

Preferably, the pressure device has a pulley block, the cable of which runs through a pulley roller supported on the first driving head. This allows a long pressure path to be produced, over which a uniformly high pushing force is exerted.

This advantage can be achieved by providing each of the lifting devices for the first and second driving heads with pulley blocks, the cable of which runs through the pulley roller supported on the respective driving head. Preferably, the coupling device has at least one, but preferably several coupling cylinders evenly spaced in the peripheral direction and lockable, the cylinder of which is connected to one driving head and the piston rod of which is connected to the other driving head and each of the connections has a detachable coupling. In this way, it can be possible to move the borer string forward or back, independently of the casing string, by a distance which corresponds to the lift of the coupling cylinders. This type of limited, independent lifting movement of the borer string is of advantage for the insertion of the casing string and the removal to the surface of loose earth. In addition, owing to the fact that they are hydraulically interlocked, the coupling cylinders ensure that the transmission of force between the two driving heads is simple and powerful even in continuous operation.

Preferably, the coupling cylinder is hinged to the second driving head and that a stop device is provided for each of them which limits the path of movement of the associated coupling cylinder. This can ensure that the coupling cylinders are kept free of any bending moments acting on them in a manner which is actually known, but it is also guaranteed that even with an inclined sledger, the coupling cylinders remain essentially aligned parallel to the sledger axis. This is an advantage for ensuring the simple release and re-closure of the coupling device.

Preferably, the stop device has several flexible buffer components spaced in the peripheral direction which are fixed to one of the two driving heads. This can ensure that the coupling cylinders are gently cushioned by the stop device.

Preferably, the coupling device has at least a first coupling component supported on a driving head and a complementary second coupling component mounted on the other driving head and that the first coupling component or the second coupling component consists of a moving locking bar which can be moved by means of a servomotor between an open position, in which the first coupling component and the second coupling component can be moved relative to each other and a working position in which the first coupling component and the second coupling component are locked so that they move together. This can allow the two driving heads to be joined together or separated from each other without requiring any manual intervention on the coupling device.

Preferably, the second coupling component has, in addition to the locking bar designed as a bolt, two cover plates which have bolt location holes and that the first coupling component has a hole which., in the locked position, forms a through location hole with the holes in the cover plates to receive the bolt-type locking bar. This can ensure that both the good control of the bolt-type locking bar and also the transmission of heavy forces.

Preferably, a stop mechanism which presets the locking position between the first coupling component and the second coupling component and which for preference has a stop plate which acts in combination with an oblate front surface of the first coupling component. This can ensure that the holes in the first coupling component and those in the second coupling component are automatically aligned. The actuation of the coupling device can thus take place without any visual checks being carried out.

Preferably, a guide mechanism for centering the first coupling component and the second coupling component on top of each other in a situation of proximity, especially even when the two driving heads are not exactly in alignment with each other or when the coupling cylinder carrying the coupling component is not aligned exactly parallel to the sledger axis.

Preferably, the boring tool includes a first limit switch, which acts in combination with the locking bar in the open position and a second limit switch, which acts in combination with the locking bar in the locked position. The limit switch can respond when the first coupling component and the counter-locking component are in alignment one on top of the other. This can ensure the automatic coupling and uncoupling of the two driving heads.

Preferably, the driven part of the second driving head supports an angular coupling which can be connected to the top end of the borer string. This allows the borer string to be swung away from the borehole axis.

Preferably, the angular coupling has two rigid, tubular coupling end pieces and an articulation piece which is sited between them and which has an articulation axis which is perpendicular to the coupling axis and in that there can slide on the tubular coupling end pieces a coupling sleeve which can be moved between a locking position, overlapping both coupling end pieces, and an open position which frees one of the coupling end pieces, preferably by means of a servomotor arrangement. This can allow the angular coupling to be locked if required to prevent any swiveling of the borer string.

Preferably, the articulation piece has several lengths of cable which are for preference evenly spaced in the peripheral direction and the ends of which are connected to the coupling end pieces and that the coupling sleeve is connected to one coupling end piece in such a way that it is incapable of rotation, but can move axially and has toothing on the front face which, in the locking position of the coupling sleeve interacts with a front face toothing connected to the second coupling end piece. In this way, the angular coupling can be arranged to have a mechanically rugged construction which is also unsusceptible to fouling.

Preferably, the inner surface of the tubular coupling end pieces are linked by a hose part. This can ensure that the inside surface of the angular coupling has a closed channel, through which concrete can be poured into the borer string as required.

Preferably, the measured length of the hose part between the front faces of the coupling end pieces is greater than the measured length of the cable lengths between the front faces of the coupling end pieces. Flexible, non-elastic materials can also be used as material for the hose part linking the coupling end pieces.

Preferably, the outside of the gap between the two coupling end pieces is sealed by a tubular cover part. This can facilitate formation of a smooth outside surface for the angular coupling.

Preferably, the first driving head is supported on the sledger via a guide which has a guide rail which runs transversely to the sledger and tangentially to the radius of turn of the sledger about the vertical axis of the turntable on a chassis and also a correspondingly circular guide nut which receives this rail form-fit. Preferably, the first driving head is connected via a detachable connection to the sledger such that it is capable of movement. These features mean that the top end of the casing string can be left open if required so that a reinforcing cage or a double T-beam can be inserted into the casing string.

Preferably, the detachable connection has a bearing mechanism for at least the guide components fitted on one side of the sledger and preferably for the guide components on a slide on the first driving head fitted on both sides of the sledger and a locking mechanism for locking the movable guide components in a working position encompassing the sledger. This allows the end of the casing to be freed simply by turning the super-structure of the chassis which carries the sledger.

Preferably, the locking mechanism has a servo-drive by means of which the guide components can be moved between their working position and an open position removed from the sledger. This can ensure that the lower, first driving head is generally securely carried on the sledger even in the event of transverse loads.

DESCRIPTION OF PREFERRED EMBODIMENTS

Figure 1:
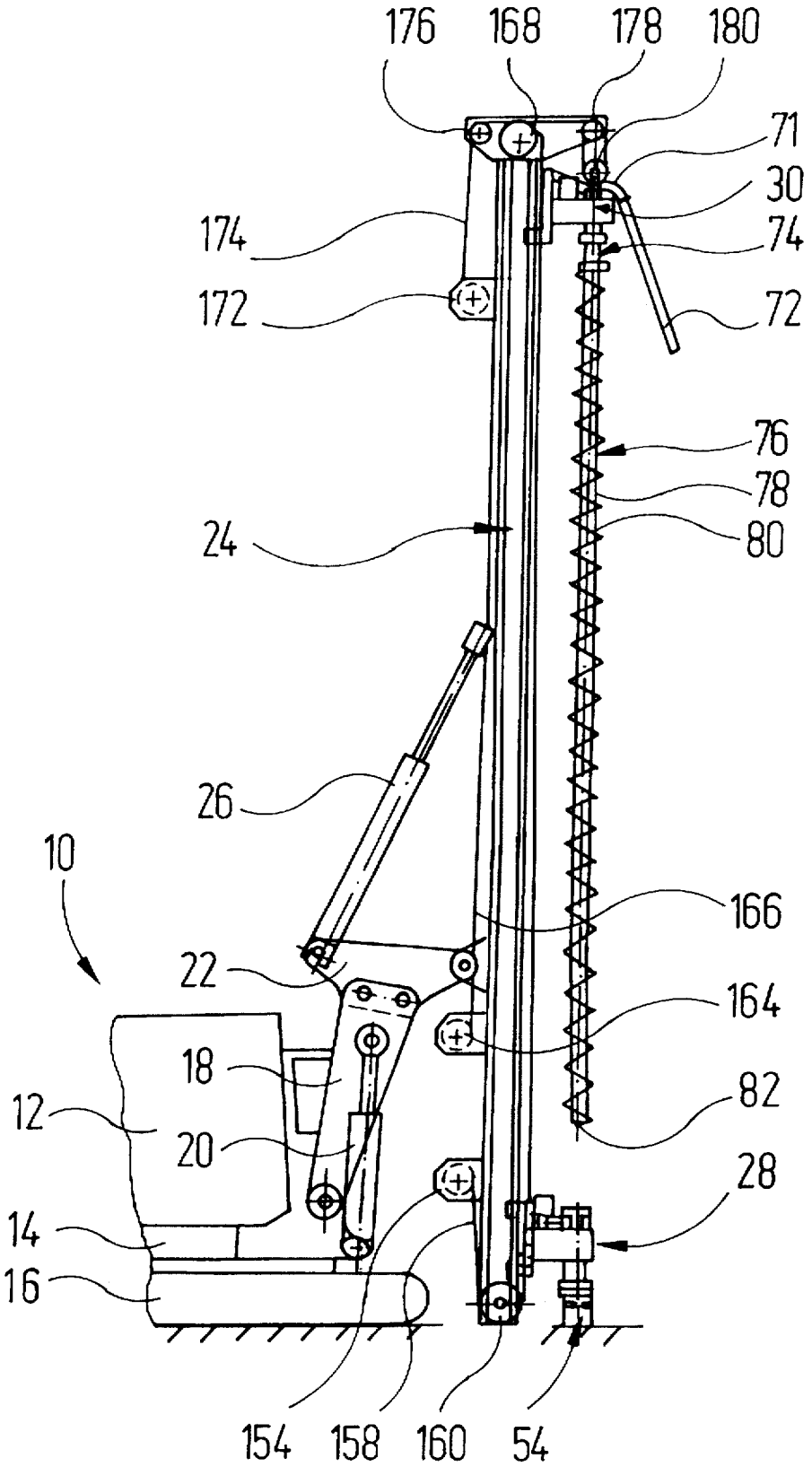
FIG. 1 is a side view of a boring tool with two driving heads for a casing string or a borer string which can be mechanically coupled if required, in which the driving heads are shown in an uncoupled state and at their maximum distance apart.

FIG. 1 shows an excavator chassis, which altogether has the reference number 10, and which has a superstructure 12 which is mounted on a running gear 16 via a turntable 14.

There is coupled to the superstructure 12 a connecting rod 18 which can be moved by means of a working cylinder 20. The connecting rod 18 in turn carries a connecting rod 22 to one end of which is coupled a sledger 24. The corresponding link point is roughly at the end of the bottom third of the sledger. At its other end, the connecting rod 22 is hinged to another working cylinder 26, whose piston rod is linked to a point on the sledger 24 which is located higher up.

A lower driving head which is designated with the reference number 28 and an upper driving head which is designated with the reference number 30 can be moved on the side of the sledger 24 which is remote from the chassis 10.

Figure 2:
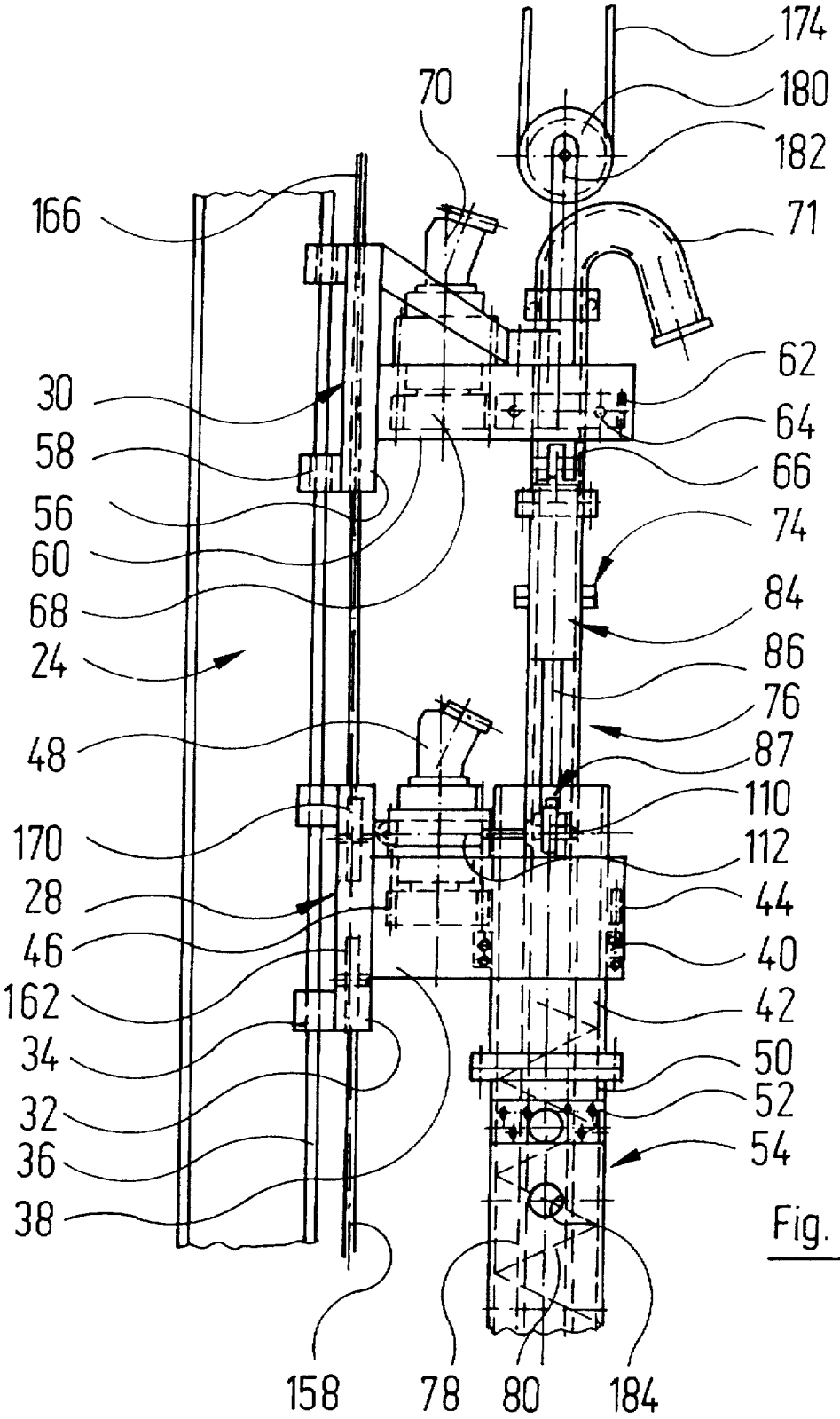
FIG. 2 is a magnified detail view of part of the boring tool shown in FIG. 1 in which the two driving heads are shown coupled to provide joint movement.

As can be seen from FIG. 2, the lower driving head 28 has a slide 32 with guide shoes 34 which overlap the guide strips 36 which extend along the leading vertical edges of the sledger 24 which is a box section square in cross-section. The slide 32 carries a drive housing 38, in which a drive sleeve 42 is supported on a bearing 40. The drive sleeve 42 is connected to a toothed rim 44 such that it cannot rotate and the latter mates with a driven pinion 46 of a hydraulic motor 48. The latter is mounted on the top of the housing 38 and its lower part extends through an opening provided in the housing cover plate.

The drive sleeve 42 is connected to a short, tubular driving part 50 which is in turn connected via several screws 52 to the top end of a casing string 54, which in turn consists of sections of casing bolted together.

The top driving head 30 has a slide 56 which overlaps the guide strips 36 on the sledger 24 with guide shoes 58. There is supported on the slide 56 a drive housing 60 in which a toothed rim 62 is supported on a bearing 64. The toothed rim 62 is connected to a driving pipe 66 such that it is capable of movement and in turn mates with the driven pinion 68 of a hydraulic motor 70.

Connected to the top end of the driving pipe 66 is a bend 71 to which a concrete feed line 72 can be connected.

The bottom end of the driving pipe 66 is connected via an angular coupling 74 which is shown only schematically in FIGS. 1 and 2 to the top end of a borer string 76, which in turn consists of segments which are bolted together.

The borer string 76 has a tubular core section 78 which essentially represents a continuation of the driving pipe 66 so that concrete delivered through the bend 72 can be poured through the inside of the borer string down to the bottom end. A coil 80 is mounted on the core section 78 and the bottom end of the core section 78 can also carry a drill bit 82 which, for example, can be a disposable part left at the bottom of the borehole.

At the top of the drive housing 60, the top ends of two coupling cylinders 84 are linked at two diametrically opposite points. The piston rods 86 of these cylinders carry a lug-like first coupling component 88 which has a center hole 90 (compare FIGS. 3 and 4). The first coupling component 88 works in combination with a second coupling component which is overall designated with the number 92 and which is secured to the top of the drive housing 38.

Figure 3:
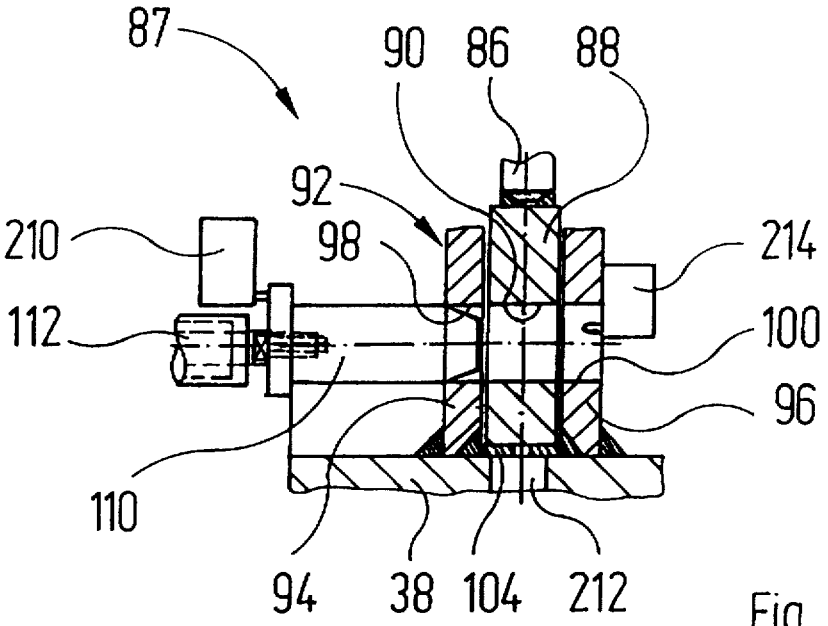
FIG. 3 is an axial section through a coupling unit of a device to couple the two driving heads, for which provision is made in the boring tool shown in FIGS. 1 and 2.
Figure 4:
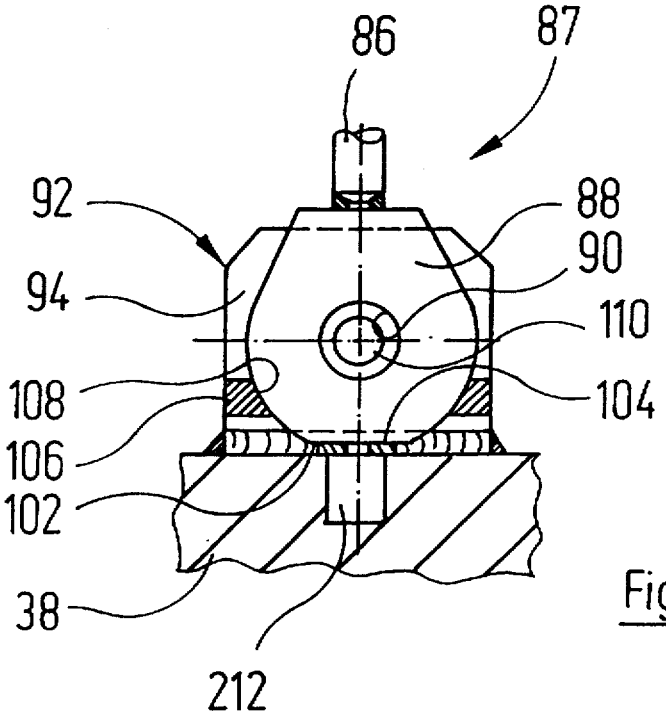
FIG. 4 is a transverse section through the coupling unit shown in FIG. 3.

As can be seen from FIGS. 2 to 4, the second coupling component 92 consists of two cover plates 94, 96 which are capable of receiving the first coupling component 88 so that there is a slight axial play between them. Holes 98, 100 are made in the cover plates 94, 96 which have the same diameter as the hole 90. As shown in FIG. 4, the first coupling component 88 has an oblate lower front face 102 which acts in combination with a stop plate 104 on the second coupling component 92. A guide plate 106 on the second coupling component has guide surfaces 108 to both sides of the lugshaped first coupling component 88, by means of which the first coupling component 88 is centered in the lateral direction shown in FIG. 4 when it is moved on to the second coupling component 92. In this way an automatic alignment of the holes 90, 98 and 100 is obtained when the piston rod 86 of the coupling cylinder 84 is extended.

A locking bolt 110, which is part of the second coupling component 92, can be moved by means of a servo cylinder 112 vertically to the plane of the cover plates 94, 96. The locking bolt 110 can be introduced into the holes 90, 98, 100 with narrow sliding clearance, as a result of which the piston rod 86 of the coupling cylinder 84 is then securely connected to the drive housing 60. In a withdrawn, released position which is shown in FIG. 3, the first coupling component 88 can, on the other hand, be removed from the second coupling component 92 when the coupling cylinder 94 is actuated in line with a retraction of its piston rod.

As already described above, in the boring tool illustrated two coupling cylinders 84 are provided in associated coupling devices, one of which is located in front of the drawing plane shown in FIG. 2 and the other of which is located behind the drawing plane shown in FIG. 2 and as a mirror image.

Figure 5:
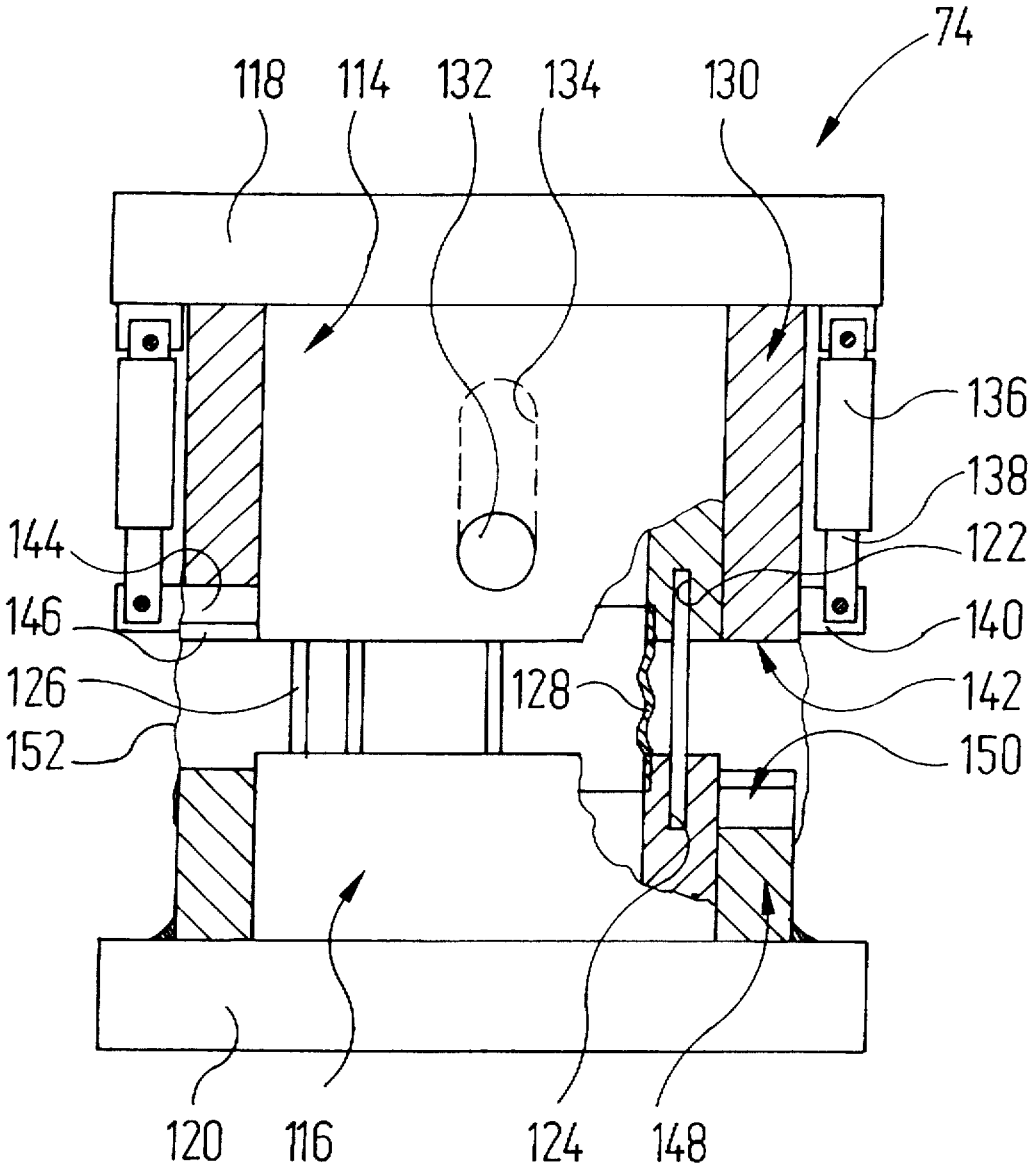
FIG. 5 is an axial section through an angular coupling, by means of which the top end of the borer string is connected to the driven part of the top driving head of the boring tool shown in FIG. 1 and 2.

As can be seen from FIG. 5, the angular coupling 74 consists of two tubular coupling end pieces 114, 116, each of which has a mounting flange 118 and 120.

Located in the front faces of the coupling end pieces 114, 116 which face each other are pocket holes 122, 124 in which the two ends of wire cable sections 126 are secured e.g. by welding. In this way, the two coupling end pieces 114, 116 are connected together under tension in such a way that the bottom coupling end piece 116 can be pivoted about axes vertical to the coupling axis, e.g. by exerting a transverse force on the bottom end of the borer string 82 which has been withdrawn from the casing string 54.

In order to obtain a closed through channel through the angular coupling 74, the gap between the front faces of the two coupling end pieces 114, 116 is bridged by a flexible hose part 128. This can either be a wire knitted fabric, a metal corrugated sheathing material or a rubber or plastic part.

As can be seen from FIG. 5, the section of the hose part 128 which is located between the front faces of the coupling end pieces is longer than the part of the wire cable sections 126 located between the front faces of the coupling end pieces. This relieves the load from the hose part 128 which can deform if the bottom coupling end piece 116 tilts, without any greater force being exerted on the hose attachment points.

A first coupling sleeve is mounted on the outer surface of the coupling end piece 114 such that it has axial movement but is incapable of rotation in order ensure a torsion-proof connection between the two coupling end pieces and the transference of forces vertically downwards. To achieve this the outside of the coupling end piece 114 has two diametrically opposite guide pins 132 which run in aligned slots 134 in the coupling sleeve 130. In order to move the coupling sleeve 130 axially, two servo cylinders 136 are fitted, the top ends of which are connected to the mounting flange 118, and the piston rods 138 of which are connected to cover plates 140 which extend radially outwards from the bottom end of the coupling sleeve 130.

Provided in the bottom front face of the coupling sleeve 130 is a front face toothing 142 which, when viewed in a radial direction, has essentially rectangular teeth 144 which have lead-in bevels 146 at the corners.

There is welded on to the bottom coupling end piece 116 a bottom, coupling sleeve 148 which has a front face toothing 150 which is complementary to the front face toothing 142.

The gap between the bottom front faces of the two coupling sleeves 130 and 148 is covered on the outside by means of a tubular cover piece 152.

There is used to move the bottom driving head 28 (compare FIGS. 1 and 2) a first winch 154, to the drum of which are secured the two ends of a wire cable section 158. The cable strands run through guide rollers 160 located one behind the other at the bottom end of the sledger and then through a pulley roller 162 mounted in the slide 32 (see FIG. 2).

By winding the cable section 158 on to the drum of the winch 15 which is driven by a hydraulic motor (not shown), an additional downwards force is thus exerted on the slide 32 which adds to the weight of the driving head 28 and the parts carried thereon.

A second winch unit 164 is used to move the driving head 28 upwards, to which the two ends of an additional wire cable section 166 are again secured by means of a drum driven by a hydraulic motor (not shown). The strands of this cable run through guide rollers 168 which are fitted at the top end of the sledger 24 and from there through an upper pulley roller 170 which is also supported in the slide 32. The driving head 28 is thus raised by winding up the length of cable 166.

To raise the driving head 30 independently, there is provided a winch unit 172, to which the two ends of an additional length of cable 174 are secured once again by means of a drum driven by a hydraulic motor (not shown). The strands of this cable run through guide rollers 176, 178 fitted at the top end of the sledger to a pulley roller 180 which is connected to the drive housing 60 via a linking part 182.

Roughly-speaking the boring tool described above operates as follows:

At the start of boring operations, both the borer string 76 and also the casing string 54 are above the ground plane. By moving the driving head 28 upwards or by lowering the driving head 30, the first coupling components 88 are brought into the second coupling components 92 and are locked in place by the pressure load of the servo cylinder (locking bolt 110 goes into the holes 98 and 100). If the winch 156 is now switched on, both driving heads 28, 30 are loaded with an additional force which is directed vertically downwards and which adds to their own weight and to the weight of the parts carried thereon (casing string, borer string). Owing to the fact that both casing string and borer string essentially advance together, an additional axial movement of the borer string 76 can be produced by the coupling cylinder 84. This therefore clears the earth in front of the lower front face of the casing (leading) or takes loose earth in the casing upwards (trailing), whereby this earth is deposited outside through openings 184 provided in the top end of the casing string.

Once the desired depth of the borehole has been reached, then the locking bolts 110 are once again moved back into the open position shown in FIGS. 3 and 4 due to the pressure load of the second working chamber of the servo cylinder 112. The top driving head 30 can now be raised independently by operating the winch unit 172 accordingly until it is in its top limit position as shown in FIG. 1.

The coupling sleeve 130 on the angular coupling 74 is now raised by the pressure load of the servo cylinder 136.

By exerting a vertical force on the bottom end of the borer string 76, the latter can then be pushed away from the borehole axis to allow good access to the top end of the casing string 54 and long reinforcing cages can be inserted into the casing string before concrete is poured into the casing string 54.

In the hitherto commonly known boring tools, it was, however, necessary to pour the concrete over the casing string first, then withdraw the casing string and remove the entire boring tool from the borehole. Any reinforcing cages which had to be inserted then had to be forced downwards into the borehole through the still wet concrete. This a difficult and delicate operation, particularly in deep boreholes, since the reinforcing cages can catch on the earth. With the boring tool described above, however, reinforcing cages can be dropped down without difficulty on the smooth inside surface of the casing string.

If the boring tool described above is used for the Berlin sheeting, then after boring the borehole and removing the borer string through the casing string as described above a double Tbeam, beam, the clear opening of which fits with clearance in the casing string 54, can simply be dropped down from above through the casing string, and then a bottom end section of the borehole is finally filled with more concrete.

Figure 6:
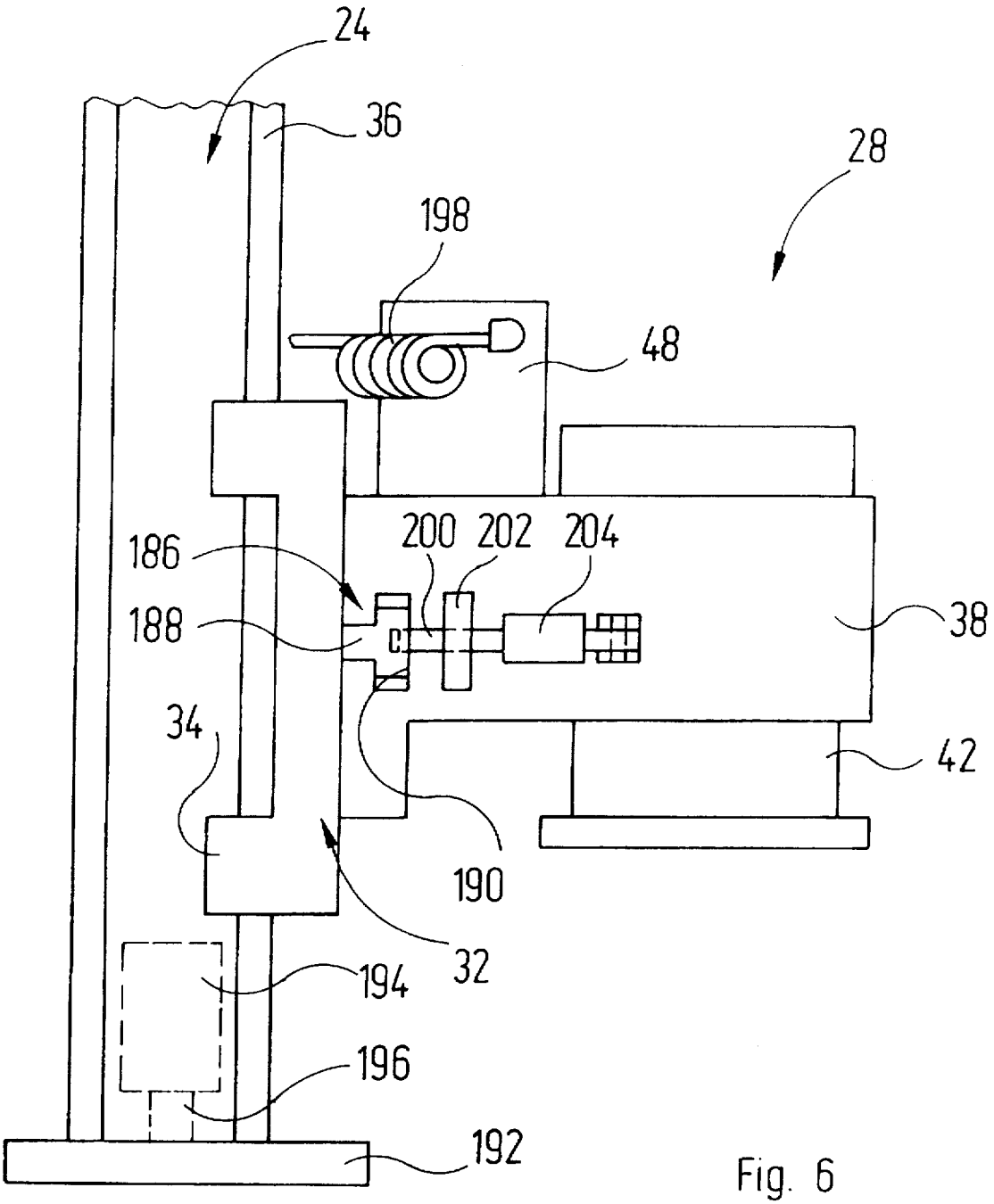
FIG. 6 is a lateral schematic view of a modified bottom driving head.
Figure 7:
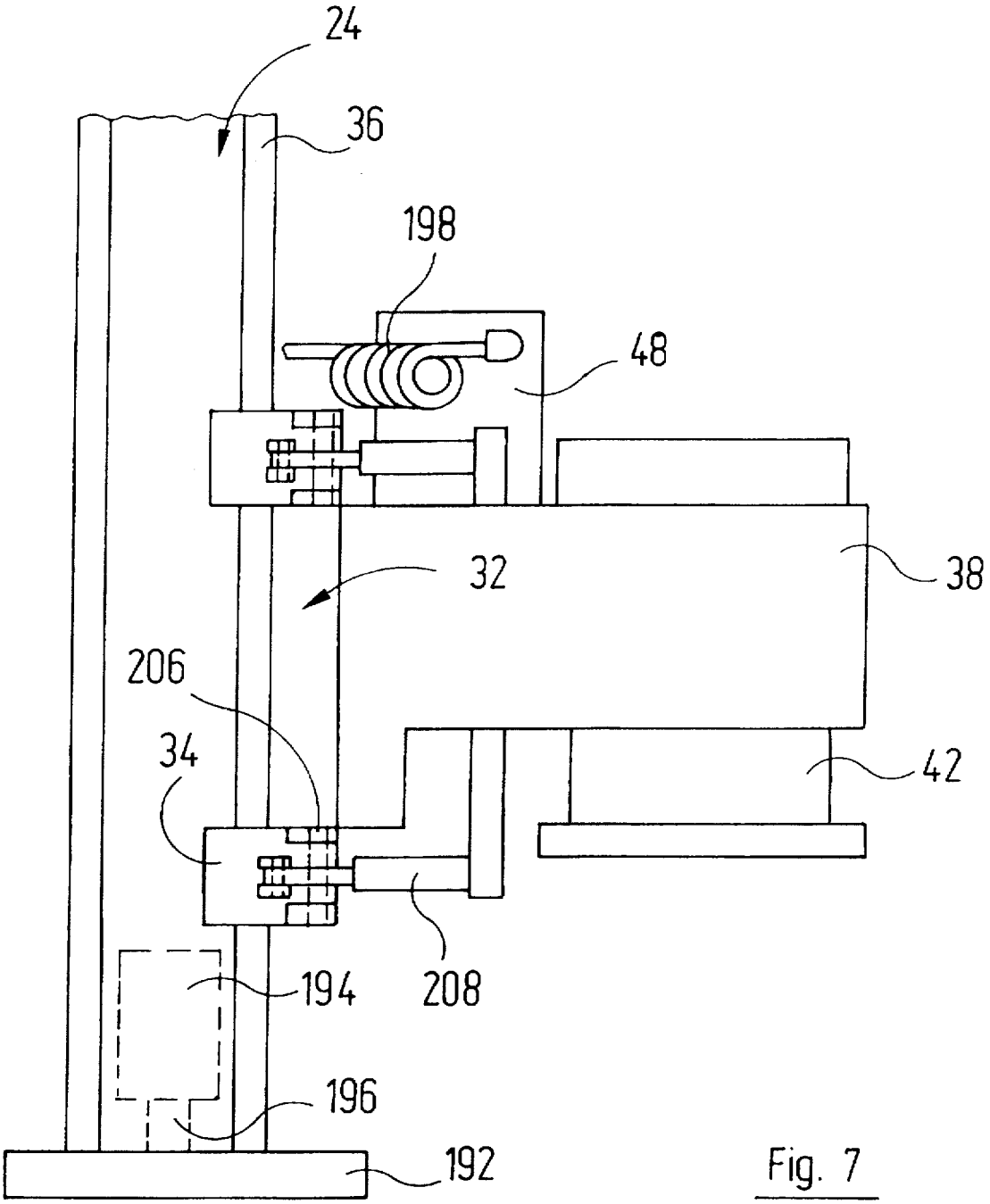
FIG. 7 is a lateral schematic view of an even more modified bottom driving head.

FIGS. 6 and 7 show alternatives to the opening at the top end of the casing string for the insertion of reinforcing cages or beams. There is fitted between the slide 32 and the drive housing 42 as shown in FIG. 6 a guide 186 which extends along an arc, the center point of which is at the axis of the turntable 14. The guide 186 consists of a guide rail 188 which is essentially T-shaped in section and which is fixed to the slide 32 and also a complementary guide groove 190, which is made in the drive housing 42.

By rotating the upper chassis 12, the sledger 24, together with the top driving head 30 and the borer string 76 supported on it can thereby be moved away from the bottom driving head 28. So as to avoid having to exert considerable force in the direction of rotation, the sledger 190 has a base plate 192 which can be raised by a servo cylinder 194. By retracting the piston rod 196 of the servo cylinder 194 on completion of the boring operations, the base plate 192 which has been forced into the ground plane during the course of the boring operations, can thus be freed again.

The rotary movement of the upper chassis required to free the casing string is small enough to allow the guide rail 188 to be given a more or less corresponding length. A helical cable 198 which allows relative movement between the sledger 24 and the drive housing 38 is used to supply the hydraulic motor 48 and also other electrical or hydraulic components on the drive housing 42.

A locking bolt 200 is fitted which runs in a guide cover plate 202 and is actuated by a servo cylinder 204 and is used to lock the guide 186 in a center working position in which the two driving heads 28, 30 are aligned.

In the embodiment shown in FIG. 7, the guide shoes 34 fitted on both sides of the slide 32 are mounted on the main slide body by means of hinges 206. Servo cylinders 208 are used to move the guide shoes 34 between the working position shown in the drawing and an open position. In the latter position, the sledger 24 can be moved slightly away from the driving head 28 by moving the chassis 10 slightly back or by turning its superstructure 12 SO that the borer string 76 stands to one side next to the axis of the casing string 54 and the latter is once again accessible from above.

When making the connection automatically between the two driving heads 28 and 30, in order that it can be ascertained from the driver's cab on the chassis 10 whether the locking component 88 has engaged correctly in the second coupling component 92, various limit switches are fitted, as shown in FIGS. 3 and 4:

A first limit switch 210 is actuated when the locking bolt 110 is in its drawn back, open position. A second limit switch 212 is actuated when the first coupling component 88 has reached a position where it has fully engaged in the second coupling component 88. A third limit switch 214 is actuated when the locking pin 110 has fully engaged in the hole 100.

In this way, the driver is constantly informed about the status of the coupling device, via which the two driving heads 28, 30 can be connected.

Figure 8:
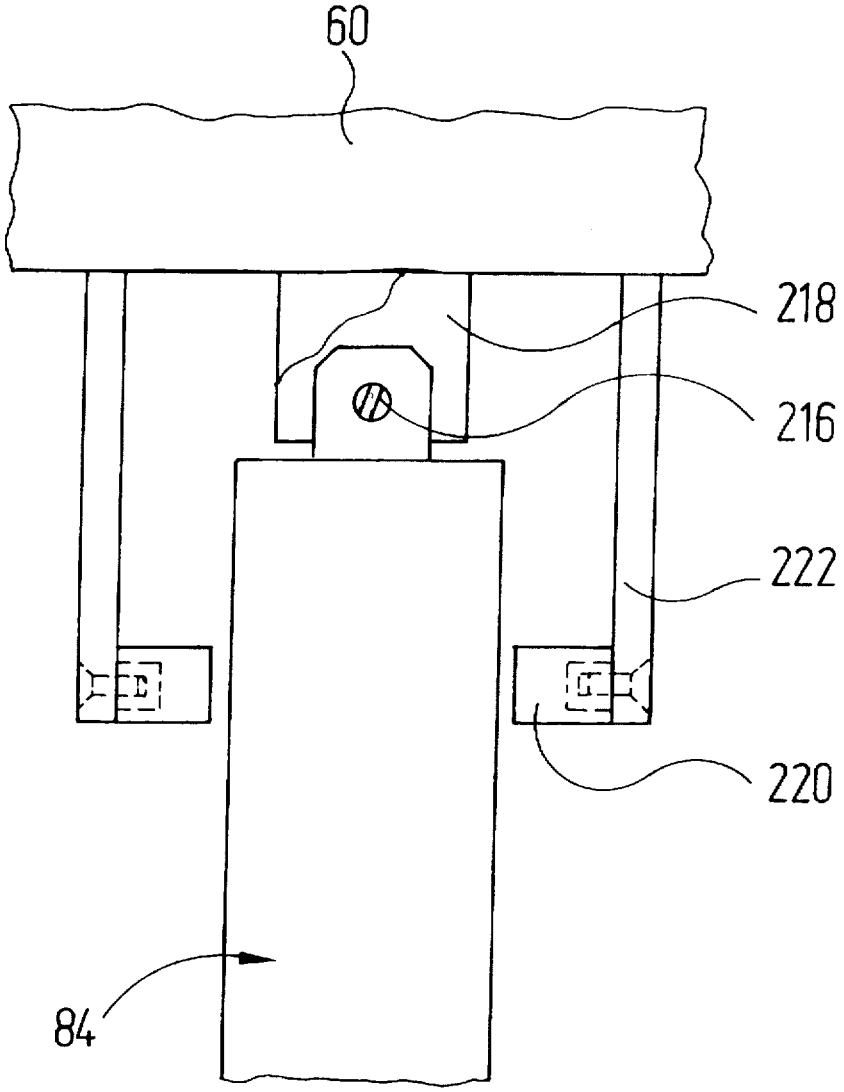
FIG. 8 is a detail view which illustrates in greater detail how a coupling cylinder is mounted on the top driving head of the boring tool shown in FIGS. 1 and 2.

As can be seen in greater detail in FIG. 8, the top ends of the coupling cylinder 84 are connected to the underside of the drive housing 60 by means of bolts 216 and cover plates 218. So that the coupling cylinders 84 extend essentially parallel to the sledger 24, even when this is in an inclined position, there are fitted to both sides of it, in a line perpendicular to the axis of rotation, two rubber buffers 220 which are carried on the driving housing 60 on posts. The rubber buffers 220 allow a limited movement of the coupling cylinders 84, but cushion them gently when the sledger is in a very inclined position.

What is claimed is:

1. A boring tool, comprising:

a sledger;

a first movable driving head mounted on the sledger and having a drivable part adapted for connection to an end of a casing string;

a second movable driving head mounted on the sledger above the first driving head and having a drivable part adapted for connection to an end of a borer string;

lifting devices adapted to raise the first and second driving heads on the sledger;

a coupling device adapted for releasable locking the first and second driving heads together to allow the first and second driving heads to move together on the sledger; and a pressure device operable on the first driving head to supply a downward force parallel to a sledger axis.

2. The boring tool of claim 1, wherein the pressure device comprises a pulley block, and further wherein a cable of the pulley block runs through a pulley roller supported on the first driving head.

3. The boring tool of claim 1, wherein the lifting devices each comprise a pulley block, and further wherein a cable of each of the pulley blocks runs through pulley rollers on the first and second driving heads, respectively.

4. The boring tool of claim 1, wherein the coupling device comprises at least one lockable coupling cylinder, and further wherein the coupling cylinder comprises a cylinder detachably connected to one of the first and second driving heads and a piston rod detachably connected to the other of the first and second driving heads.

5. The boring tool of claim 4, wherein the coupling device comprises a plurality of the coupling cylinders evenly spaced in a peripheral direction.

6. The boring tool of claim 4, wherein the coupling cylinder is hinged to the second driving head and further wherein the coupling cylinder comprises a stop device for limiting movement of the coupling cylinder.

7. The boring tool of claim 6, wherein the stop device comprises a plurality of peripherally spaced flexible buffer components fixed to one of the first and second driving heads.

8. The boring tool of claim 1, wherein the coupling device comprises:

a first coupling component supported on one of the first and second driving leads, and a complementary second coupling component supported on the other of the first and second driving heads, wherein at least one of the first and second coupling components comprises a locking bar, the locking bar being movable by a servo motor between an open position in which the first coupling component and the second coupling component are movable relative to one another and a working position in which the first and second coupling components are locked to prevent their relative movement.

9. The boring tool of claim 8, wherein the locking bar comprises a bolt, and further wherein the second coupling component comprises the locking bar and further comprises two cover plates, each having a bolt location hole, and the first coupling component is provided with a hole, which hole, with the bolt location holes, forms a through location hole to receive the locking bar in the locked position of the locking bar.

10. The boring tool of claim 9, further comprising a stop mechanism presetting the locking position of the locking bar between the first coupling component and the second coupling component.

11. The boring tool of claim 10, wherein the stop mechanism comprises a stop plate adapted for acting in combination with an oblate front surface of the first coupling component.

12. The boring tool of claim 8, further comprising a guide mechanism adapted for centering the first coupling component and the second coupling component on top of each other and in proximity to one another.

13. The boring tool of claim 8, further comprising a first limit switch adapted to act in combination with the locking bar in the open position, and a second limit switch adapted to act in combination with the locking bar in the working position.

14. The boring tool of claim 8, further comprising a limit switch adapted to respond when the first coupling component and the locking bar are in alignment with one on top of the other.

15. The boring tool of claim 1, wherein the drivable part of the second driving head supports an angular coupling adapted for connection to a top end of a borer string.

16. The boring tool of claim 15, wherein the angular coupling comprises:

two rigid, tubular coupling end pieces;

an articulation piece between the tubular coupling end pieces and having an articulation axis perpendicular to a coupling axis;

a coupling sleeve slidable on the tubular coupling end pieces and movable between a locking position overlapping both tubular coupling end pieces and an open position wherein one of the tubular coupling end pieces is free of the coupling sleeve.

17. The boring tool of claim 16, further comprising a servo motor arrangement for moving the coupling sleeve.

18. The boring tool of claim 16, wherein the articulation piece comprises:

a plurality of cables, the ends of each cable being connected to the coupling end pieces, and wherein the coupling sleeve is connected to one of the coupling end pieces to permit its axial movement and prohibit its rotational movement, and further wherein the coupling sleeve comprises a toothing on its front face which is adapted to interact with a front face toothing on the other of the coupling end pieces in the locked position.

19. The boring tool of claim 18, wherein the cables are evenly spaced in a peripheral direction.

20. The boring tool of claim 18, wherein inner surfaces of the tubular coupling end pieces are linked by a hose part.

21. The boring tool of claim 20, wherein a length of the hose part between front faces of the coupling end pieces is greater than lengths of the cables between the front faces.

22. The boring tool of claim 21, wherein an outside gap between the coupling end pieces is sealed by a tubular cover part.

23. The boring tool of claim 1, wherein the first driving head is supported on the sledger by a guide comprising a guide rail running transversely to the sledger and tangentially to a turn radius of the sledger about a vertical axis of a turntable on a chassis and to a correspondingly circular guide nut which receives the rail form-fit.

24. The boring tool of claim 1, wherein the first driving head is detachably connected by a connector to the sledger to permit movement of the first driving head.

25. The boring tool of claim 24, wherein the detachable connector comprises:

a bearing mechanism for movable guide components fitted on one side of the sledger, and a locking mechanism adapted to lock the movable guide components in a working position encompassing the sledger.

26. The boring tool of claim 25, wherein the detachable connector comprises a bearing mechanism for guide components fitted on both sides of the sledger.

27. The boring tool of claim 25, wherein the locking mechanism comprises a servo-drive adapted to move the guide components between a working position and an open position removed from the sledger.

* * * * *